US009526326B2

(12) United States Patent
Neumann et al.

(10) Patent No.: US 9,526,326 B2
(45) Date of Patent: Dec. 27, 2016

(54) FLUID-DISPENSING APPARATUS

(71) Applicant: EASY-DO PRODUCTS LIMITED, London (GB)

(72) Inventors: Paul Neumann, London (GB); Daniel Neumann, London (GB)

(73) Assignee: EASY-DO PRODUCTS LIMITED (GB)

( * ) Notice: Subject to any disclaimer, the term of this patent is extended or adjusted under 35 U.S.C. 154(b) by 0 days.

(21) Appl. No.: 14/788,197

(22) Filed: Jun. 30, 2015

(65) Prior Publication Data

US 2016/0000213 A1 Jan. 7, 2016

(30) Foreign Application Priority Data

Jul. 1, 2014 (GB) ..... 1411689.1

(51) Int. Cl.
*A46B 11/00* (2006.01)
*A47L 13/22* (2006.01)
(Continued)

(52) U.S. Cl.
CPC ..... *A46B 11/001* (2013.01); *A46B 11/002* (2013.01); *A46B 11/0013* (2013.01); *A47L 13/22* (2013.01);
(Continued)

(58) Field of Classification Search
CPC combination set(s) only.
See application file for complete search history.

(56) References Cited

U.S. PATENT DOCUMENTS 729,515 A 5/1903 Steele ..... 401/273
2,823,401 A * 2/1958 O'Higgins ..... A46B 11/0041 222/243
(Continued)

FOREIGN PATENT DOCUMENTS

EP 0161113 11/1985 ..... A47L 13/17
EP 0161907 11/1985 ..... A46B 11/04
(Continued)

OTHER PUBLICATIONS

French Design Registration No. 0379076 (1 pg).
(Continued)

*Primary Examiner* — David Walczak
(74) *Attorney, Agent, or Firm* — Hayes Soloway P.C.

(57) ABSTRACT

A fluid-dispensing apparatus, comprises a hollow handle, a working head from which fluid may be dispensed and an intermediate member, the hollow handle providing an enclosure defining a fluid reservoir therein, the handle having a distal end portion and having an outlet located in the distal end portion, the working head having a dispensing aperture for dispensing of fluid, the intermediate member being configured to receive the distal end portion of the handle therein, the working head being attachable to the intermediate member, the intermediate member has an opening which is in alignment with the outlet of the handle and with the dispensing aperture of the working head when assembled. The apparatus comprises a flow control member, which is received within the intermediate member and is movable to align apertures of different sizes with the handle outlet, providing discrete flow control configurations.

19 Claims, 11 Drawing Sheets

(51) Int. Cl.
*A47L 23/05* (2006.01)
*A46B 9/00* (2006.01)

(52) U.S. Cl.
CPC ..... *A47L 23/05* (2013.01); *A46B 9/005* (2013.01); *A46B 2200/3033* (2013.01)

(56) References Cited

U.S. PATENT DOCUMENTS

| | | | | |
|---|---|---|---|---|
| 3,653,779 | A | 4/1972 | Schwartzman | 401/206 |
| 3,661,468 | A | 5/1972 | Schwartzman | 401/206 |
| 3,805,990 | A | 4/1974 | Palaudarias | 220/44 R |
| 4,101,053 | A | 7/1978 | Mast, Jr. | 221/232 |
| D267,282 | S | 12/1982 | Gross | D32/51 |
| 4,826,340 | A * | 5/1989 | Rothweiler | A46B 7/04 401/205 |
| D306,924 | S | 3/1990 | Shapton | D32/45 |
| 4,966,484 | A | 10/1990 | Kimura | 401/273 |
| 5,120,148 | A | 6/1992 | Waters et al. | 401/264 |
| D387,704 | S | 12/1997 | Berti | D4/114 |
| D389,625 | S | 1/1998 | Feldman et al. | D32/49 |
| 6,893,183 | B2 | 5/2005 | Levison | A46B 11/00 |
| D511,626 | S | 11/2005 | Hay et al. | D4/138 |
| 7,146,676 | B2 | 12/2006 | Kubes et al. | 15/244.1 |
| D549,412 | S | 8/2007 | McNeeley et al. | D32/45 |
| D558,417 | S | 12/2007 | Libman et al. | D32/45 |
| D606,269 | S | 12/2009 | Treeby et al. | D32/40 |
| 7,771,135 | B2 * | 8/2010 | Bizzotto | A47L 13/17 401/196 |
| 8,262,307 | B1 * | 9/2012 | Cross | A46B 11/0041 401/183 |
| 2004/0105715 | A1 * | 6/2004 | Spelman | A46B 11/0013 401/6 |
| 2005/0147461 | A1 | 7/2005 | Glover | 401/279 |
| 2007/0212161 | A1 | 9/2007 | Carlson | 401/289 |
| 2010/0054844 | A1 | 3/2010 | Thorpe | 401/172 |
| 2010/0119289 | A1 | 5/2010 | Schmidig | 401/138 |

FOREIGN PATENT DOCUMENTS

| | | | |
|---|---|---|---|
| EP | 000038807-0001 | 11/2003 | |
| EP | 000093521-0001 | 2/2004 | |
| EP | 000093521-0002 | 2/2004 | |
| GB | 141183 | 4/1920 | |
| GB | 2369560 | 6/2002 | A47L 13/26 |
| GB | 2395680 | 6/2004 | B25G 1/04 |
| WO | WO9963857 | 12/1999 | A46B 11/00 |
| WO | WO0241745 | 5/2002 | A47L 13/17 |
| WO | WO2007137354 | 12/2007 | A46B 11/04 |

OTHER PUBLICATIONS

French Design Registration No. 0379077 (1 pg).
French Design Registration No. 0379078 (1 pg).
International Search Report issued in application No. PCT/GB01/05173, dated Apr. 4, 2002 (3 pgs).
UK Search Report issued in application No. GB1411689.1, dated Dec. 8, 2014 (4 pgs).

* cited by examiner

FLUID-DISPENSING APPARATUS

FIELD OF THE INVENTION

The present invention concerns an improved fluid-dispensing apparatus of the type comprising a hollow handle for dispensing fluid and carrying a working head such as a sponge, brush or the like. Such hand-held fluid-dispensing utensils are in particular useful for cleaning.

BACKGROUND TO THE INVENTION

Hand-held cleaning utensils that dispense fluid such as soap or detergent exist in a variety of forms. Such utensils typically include a fluid reservoir, a closeable opening for filling the reservoir, and means for dispensing the fluid from the reservoir to the cleaning head, comprising bristles or a sponge or the like. It is known to produce the working head as a detachable unit. The present invention seeks to provide inter alia improvements relating to such fluid-dispensing utensils.

SUMMARY OF INVENTION

According to a first aspect of the invention there is provided a fluid-dispensing apparatus comprising a hollow handle, a working head from which fluid may be dispensed and an intermediate member, the hollow handle providing an enclosure defining a fluid reservoir therein, the handle having a distal end portion and having an outlet located in the distal end portion, the working head having a dispensing aperture for dispensing of fluid, the intermediate member being configured to receive the distal end portion of the handle therein, the working head being attachable to the intermediate member, the intermediate member having a dispensing aperture, the dispensing aperture of the intermediate member being in alignment with the outlet of the handle and with the dispensing aperture of the working head when assembled.

Alignment of the dispensing aperture of the intermediate member with the outlet of the handle and with the dispensing aperture of the working head allows fluid to flow from the reservoir in the handle, via the dispensing aperture in the intermediate member and out of the dispensing aperture in the working head. Suitably the dispensing aperture of the intermediate member is in registry with the dispensing aperture of the working head when assembled. Suitably the dispensing aperture of the intermediate member is also in registry with the outlet of the handle (whether directly or with another apertured member there between) when assembled. Suitably the outlet of the handle is located at or near the distal end of the distal end portion of the handle. Preferably the distal end portion of the handle extends into and is received within the intermediate member when assembled. The outlet of the handle is therefore received within the intermediate member when assembled. Part of the fluid enclosure provided by the handle effectively extends into and is housed within the intermediate member. The apparatus may be a cleaning utensil, preferably a hand-held utensil.

The present arrangement provides an improvement over existing utensils in that the intermediate member, to which the working head attaches in the present invention, can be provided as a separate unit prior to manufacturing assembly, in different shapes and/or sizes to suit different uses. This provides efficiency in manufacturing of the utensil. The assembly described above also allows for means for controlling the flow of fluid from the fluid reservoir to be easily assembled as part of the utensil assembly, providing further efficiencies in manufacture.

Preferably the apparatus further comprises a flow control member for controlling the flow of fluid from the handle, the flow control member being movable with respect to the handle outlet for selectively controlling the flow. The flow control member may be movable with respect to the handle outlet for selectively opening and closing the outlet and/or selectively controlling the level of flow. By having the intermediate member as a separate piece from the hollow handle, this allows the flow control member to be assembled into the apparatus prior to coupling of the intermediate member with the handle. Furthermore, the part of the flow control member which moves to and fro across the handle outlet to control fluid flow is not accessible to the user when the working head is removed, therefore there is no risk of the flow control member becoming dislodged or broken when a working head is not attached to the utensil. The intermediate member therefore protects the flow control member.

Preferably the flow control member is received within the intermediate member.

Preferably the flow control member has a valve portion, the valve portion being received in a space between a surface of the handle and a surface of the intermediate member. Suitably the valve portion is received between the handle outlet and the dispensing aperture of the intermediate member. The valve portion suitably controls fluid flow from the fluid reservoir in the handle.

Preferably the valve portion of the flow control member has at least a first aperture, the valve portion being movable with respect to the handle outlet for selectively aligning the first aperture with the handle outlet. Since the handle outlet is aligned with the dispensing apertures of the intermediate member and working head, alignment of the first aperture with the outlet of the handle also aligns the first aperture with the dispensing apertures of the intermediate member and working head.

Preferably the flow control member is movable between at least a first open position in which the first aperture is aligned with the handle outlet and a closed position in which part of the valve portion blocks the handle outlet. Fluid is blocked from flowing out of the handle outlet when the flow control member is in the closed position. The user can selectively move the flow control member between closed and open positions to selectively stop or allow fluid to be dispensed from the utensil. When the flow control member is in the closed position, this prevents leakage of the fluid from the handle (e.g. under gravity and capillary action), which is useful for when the apparatus is not in use.

Preferably the valve portion of the flow control member has at least first and second apertures of different sizes, the valve member being movable with respect to the handle outlet for selectively aligning the first or second aperture with the handle outlet. This allows the flow of fluid dispensed from the apparatus to be controlled. The user can select between discrete flow control options provided by the apertures of different sizes. This prevents waste and allows the user to select an appropriate amount of fluid to be dispensed in accordance with their needs. Suitably first and second apertures in the valve portion are circular apertures having differing diameters Preferably the flow control member is movable between first and second open positions corresponding to first and second discrete flow control positions, wherein when the flow control member is in the first open position the first aperture aligns with the handle outlet and in the second open position the second aperture aligns with the handle outlet.

Preferably the flow control member can be maintained in an open position or closed position via detent action.

Preferably one of the flow control member and an adjacent surface has a detent and the other has at least one detent recess for receiving the detent for maintaining the flow control member in a selected position via detent action.

Preferably the flow control member has a detent and an adjacent surface of the handle has at least one detent recess for receiving the detent for maintaining the flow control member in a selected position via detent action. Suitably the handle has a first detent recess for receiving the detent to maintain the flow control member in the first open position, a second detent recess for receiving the detent to maintain the flow control member in the second open position, and a third detent recess for receiving the detent to maintain the flow control member in the closed position.

Preferably the flow control member is slidably movable relative to the handle. Preferably the flow control member is linearly movable relative to the handle.

Preferably the flow control member has a throughbore for receiving at least part of the distal end portion of the handle therethrough.

Preferably the flow control member has an actuator portion, the actuator portion being accessible by a user, wherein movement of the actuator portion by the user causes the valve portion of the flow control member to move with respect to the handle outlet.

Preferably the actuator portion of the flow control member is located on one side of the handle and the valve portion is located on the opposite side of the handle.

Preferably wherein the intermediate member has an opening, the opening being configured such that the actuator portion protrudes through said opening. This allows the actuator portion to be accessible to the user. The opening is preferably slot shaped such that the actuator portion can be moved linearly between the opening and closed positions Preferably the the actuator portion is movable distally relative to the handle to move the flow control member from the closed position to an open position.

Preferably the distal end portion of the handle has a recessed area for receiving the valve portion of the flow control member.

Preferably at least part of the distal end portion of the handle engages with an internal surface of the intermediate member. Suitably a part of the distal end portion of the handle at or near the distal end of the distal end portion engages with an internal surface of the intermediate member when assembled.

Preferably the intermediate member has an opening for receiving the distal end portion of the handle therein. The opening in the intermediate member for receiving the distal end portion of the handle is preferably in a proximal part of the intermediate member, and preferably at the proximal end of the intermediate member. The outlet of the intermediate member is preferably at or near the distal end of the intermediate member.

Preferably the working head is releasably attachable to the intermediate member. This allows the working head to be removed and replaced with another working head, for example if the working head is worn or an alternative type of working head is desired.

Preferably the working head is attachable to the intermediate member via a latching attachment.

Preferably the working head comprises a base plate and a cleaning element. Preferably the cleaning element comprises a sponge or brush.

Preferably the handle has an opening through which fluid can be introduced into the interior of the handle, the opening being sealed by a cap in use. The cap is suitably releasably attachable to the handle. Preferably the cap attaches to the handle via a bayonet fitting.

According to a further aspect of the invention there is provided a kit for assembly into a fluid-dispensing apparatus, wherein the kit comprises parts of an assembly according as described above. Preferably kit comprising two or more said intermediate members of different sizes and/or shapes.

The term "proximal" as used herein will refer to the end of a device or system that is closest to the operator in use, while the term "distal" will refer to the end of the device or system that is farthest from the operator.

Throughout this specification and claims, unless the context requires otherwise, the word "comprise" or variations such as "comprises" or "comprising", will be understood to imply the inclusion of a stated integer or group of integers but not the exclusion of any other integer or group of integers.

BRIEF DESCRIPTION OF THE DRAWINGS

A preferred embodiment of the present invention will now be more particularly described by way of example only with reference to the accompanying drawings, wherein.

DESCRIPTION OF THE PREFERRED EMBODIMENTS

The present embodiments represent currently the best ways known to the applicant of putting the invention into practice. But they are not the only ways in which this can be achieved. They are illustrated, and they will now be described, by way of example only.

Referring to FIGS. 1 to 9, these illustrate a preferred embodiment of the invention which comprises a fluid-dispensing apparatus 10 in the nature of a dish cleaning implement. The apparatus 10 is an assembly of several discrete units as will be described further below. The term "proximal" as used herein refers to a part of a device or system that is close to the operator in use, while the term "distal" refers to the end of the device or system that is away from the operator. References to the lower side of the apparatus refer to the side that faces generally towards the surface or item being cleaned when in use and references to the upper side of the apparatus refer to the side that faces generally away from the surface or item being cleaned when in use. The term "transverse" as used herein refers to a plane extending generally in a cross direction to the long axis of the apparatus.

Figure 3:
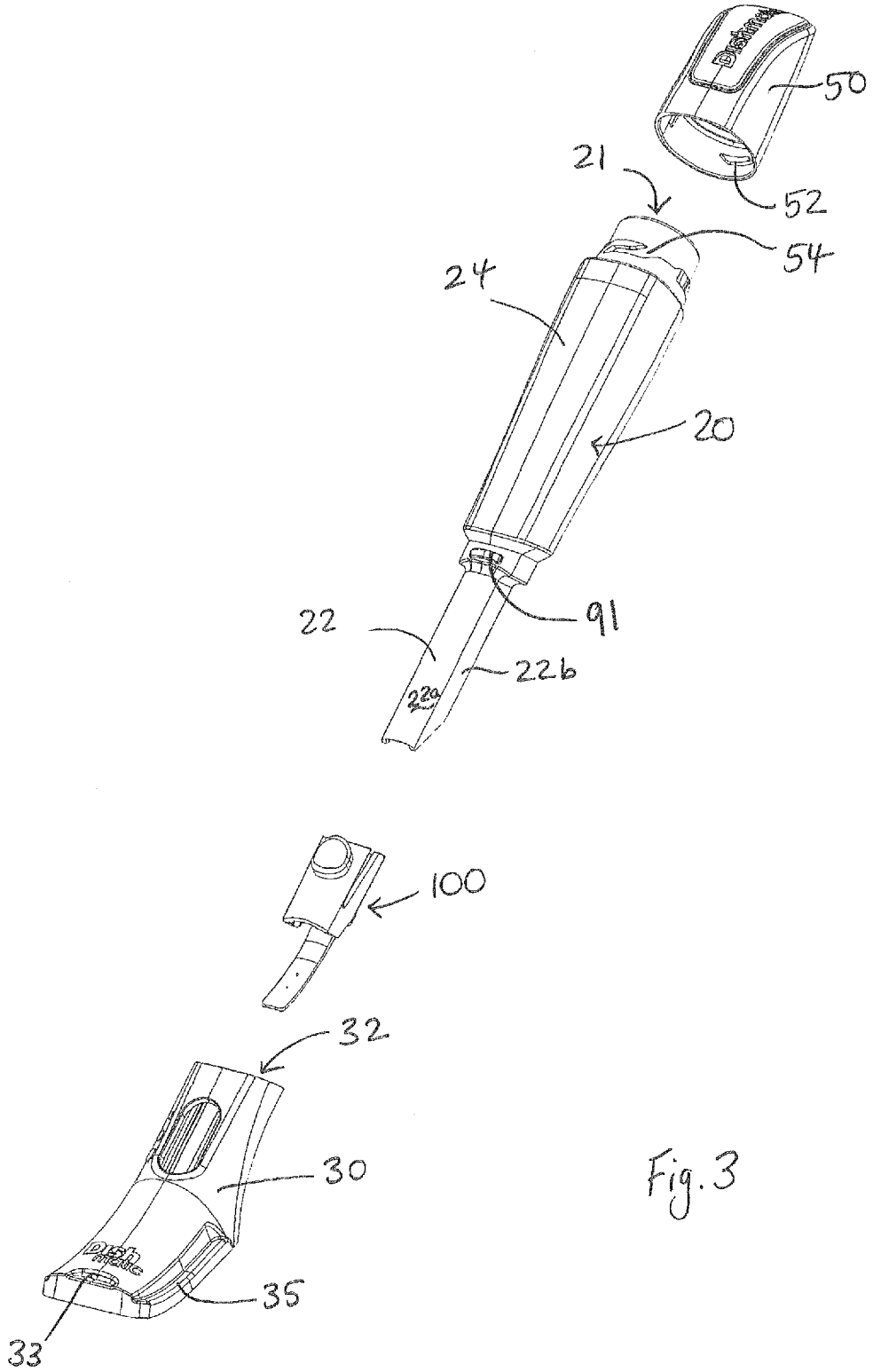
FIG. 3 is an exploded perspective view from above of the apparatus of FIG. 1, the working head not shown in the figure.

The apparatus has a handle or housing 20 which is an enclosure defining a fluid reservoir for storage of detergent (i.e. washing up liquid). Referring to FIG. 3, the handle 20 has a distal end portion 22, which is received within an intermediate member 30. The intermediate member 30 has a distal part and a proximal part and the apparatus further comprises a working head 40 releasably mounted to the distal part of intermediate member 30. The end of the handle 20 remote from the working head 40 (i.e. the proximal end of the handle 20) has an opening 21 through which fluid can be introduced into the interior of the handle 20, the opening being sealed by a cap 50 in use. The cap 50 is removable so that the handle can be filled with detergent as needed and re-sealed using the cap 50.

Figure 4:
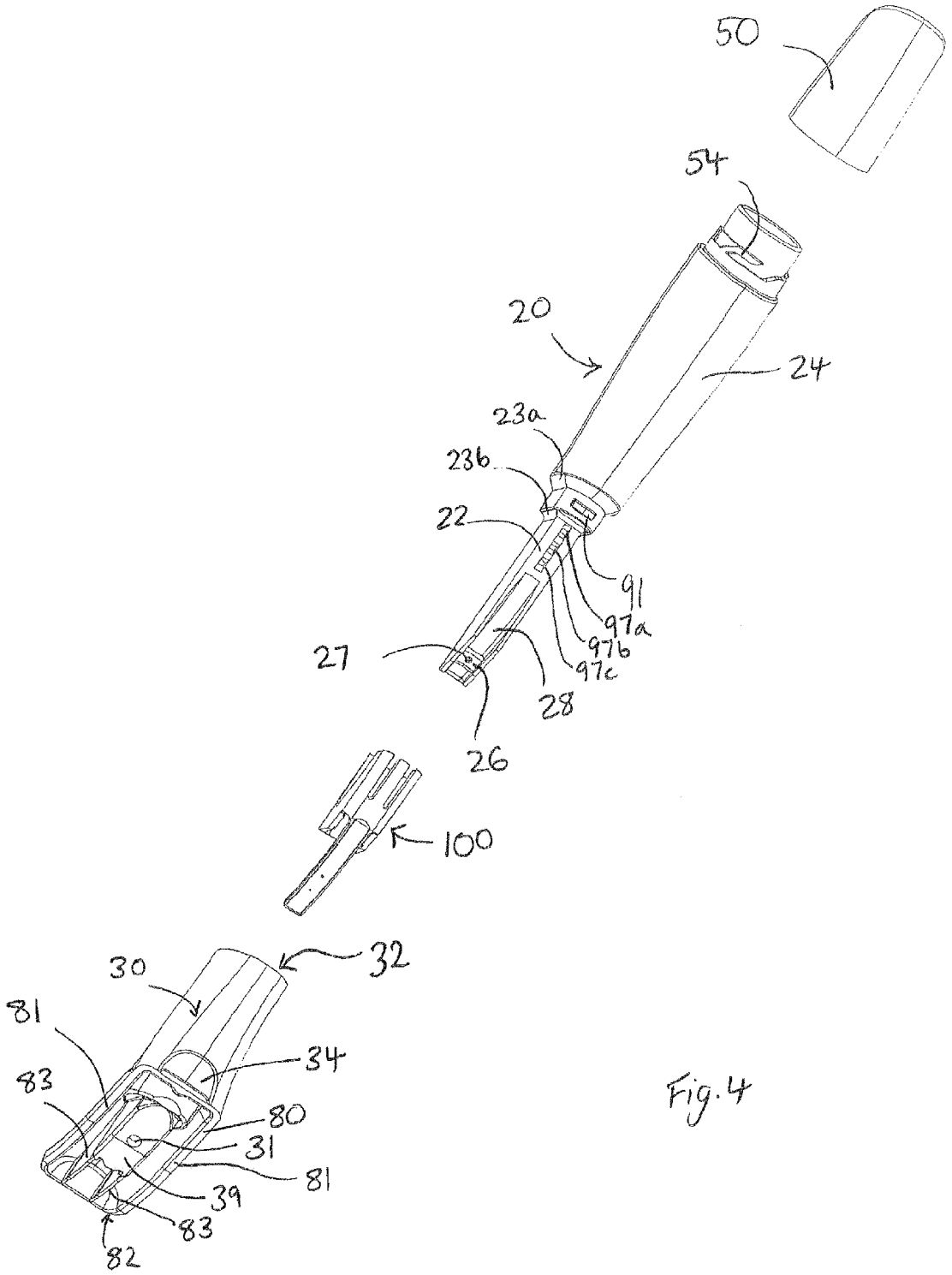
FIG. 4 is an exploded perspective view from below of the apparatus of FIG. 1, the working head not shown in the figure.

Referring to FIG. 3, the handle 20 has a distal end portion 22 and a main body portion 24. The distal end portion 22 extends from the main body portion 24, the distal end portion 22 having a smaller transverse cross-section than the main body portion 24. Referring to FIG. 4, the distal end portion 22 of the handle 20 has a distal end face 26 near the distal end of the handle 20, the distal end face 26 having a dispensing aperture or outlet 27 therein. The handle 20 has a first shoulder 23*a* at the point where the distal end portion 22 extends from the main body portion 24 of the handle 20. The handle 20 has a second shoulder 23*b* slightly distal of the first shoulder.

The intermediate member 30 has an inner tubular sleeve 37 (visible in FIG. 8) that is shaped to receive the distal end portion 22 of the handle 20 therein. The intermediate member 30 has an opening 32 at its proximal end, serving as an opening to the inner tubular sleeve. The distal end portion 22 of the handle 20 forms a male connection member and the inner tubular sleeve of the intermediate member 30 forms a female connection member for coupling the handle 20 and intermediate member 30 with one another. In some embodiments the distal end portion 22 of the handle 20 may taper slightly in the distal direction, in which case the inner tubular sleeve of the intermediate member 30 is correspondingly internally tapered. Referring to FIG. 3, the distal end portion 22 has a convexly curved upper surface 22*a* in its transverse cross-section and flat sides 22*b* extending away from the curved upper surface 22*a*. By means of having a non-symmetrical transverse cross-sectional shape, the distal end portion 22 can only be inserted in the intermediate member 30 in one orientation.

Referring to FIGS. 3 and 4, the handle 20 has two protrusions 91 between the first and second shoulders 23*a*, 23*b*, one protrusion 91 on the upper side of the handle and one protrusion 91 on the lower side. The inner tubular sleeve 37 of the intermediate member 30 has corresponding recesses 38 (visible in FIG. 8) for receiving each protrusion 91 so as to lockingly attach the intermediate member 30 to the handle 20 via a snap engagement. The snap engagement is strong and once the handle 20 and intermediate member 30 are assembled together during manufacture of the apparatus, they are not intended to be de-coupled from one another.

The inner tubular sleeve terminates at its distal end in a distal end face 39, visible in FIG. 4. The distal end face 39 has a dispensing aperture 31 therein, which aligns with the outlet 27 of the handle 20 when assembled. The intermediate member 30 has an outer skirt 80 that forms the outer sides of the intermediate member 30 and which flares outwardly and distally, terminating in an oblong end wall 82 at its distal end. The oblong end wall 82 has side edges 81 that are curved in a plane parallel with the longitudinal axis of the apparatus. The distal end face 39 of the inner tubular sleeve 37 is substantially flush with the oblong end wall 82, and is joined to the outer skirt 80 by one or more bridging walls 83 to provide rigidity.

The handle 20 has a generally circular or oval transverse cross-section but with a curvilinear upper side to give the handle an ergonomic shape. The handle tapers distally. When the handle 20 and intermediate member 30 are assembled together, the intermediate member 30 effectively provides a foot for the handle 20 to which the working head 40 can be mounted, the intermediate member 30 effectively extending the length of the body of the utensil when assembled. The opening 32 of the intermediate member 30 abuts the first shoulder 23*a* of the handle when assembled and the outer surface of the intermediate member 30 is flush with the outer surface of the main body portion 24 of the handle where the pieces engage with one another to give the utensil a sleek profile.

The working head 40 includes a foam/sponge pad 41 and a base plate 44. The foam pad 41 is moulded, adhered or otherwise fastened to the base plate 44. In the embodiment in the figures, the foam pad 41 has an abrasive foam layer 42 (useful for scouring) facing away from the base plate 44, however the working head 40 may include a single piece of non-abrasive foam without any abrasive foam layer. Instead of a foam pad, the working head 40 may have any other suitable scouring or cleaning element, such as a brush with bristles extending from the base plate 44. The same handle 20 and intermediate member 30, which together form a handle assembly, may be used with different types of working head simply by detaching one working head and substituting it with another; in this way, the working head can be selected to suit the particular task to be carried out.

Figure 9:
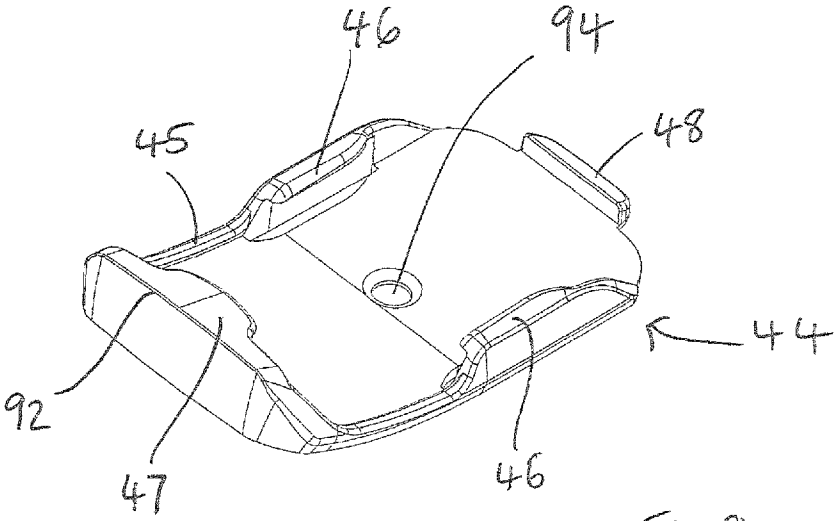
FIG. 9 is a perspective view from above of the base plate of the working head of FIG. 1.

Referring to FIG. 9, the base plate 44 is formed of a sheet of plastics material. The base plate 44 comprises a generally flat or slightly curved plate that is oblong in shape. An upwardly extending rim 45 extends about the perimeter of the plate's upper surface along the distal end and the two long sides of the base plate 44. A pair of locking projections 46, extend from the rim 45 towards each other, one on each side of the base plate 44. The base plate 44 has a further inward facing distal projection 47 extending from the rim 45 on the distal side of the base plate 44 and an upstanding projection 48 extending from the proximal end of the base plate 44. The locking projections 46 are received by a corresponding pair of recessed channels 35, one on each side of the outer surface of skirt 80 of the intermediate member 30, the distal projection 47 is received in a distal end recess 33 on the distal end of the skirt 80 and the upstanding projection 48 is received in a corresponding proximal recess 34 of the skirt 80. The projections 46, 47, 48 are received in the corresponding recesses of the intermediate member 30 to attach the base plate 44 of the working head 40 to the intermediate member 30 via a snap engagement. The base plate 44 is sufficiently flexible such that the working head 40 can be detached from the intermediate member 30 by flexing the base plate 44 to disengage the distal projection 47 from recess 34 so that the base plate 44 can be slidably removed from the engagement of projections 46, 47.

Extending distally from the distal end of the base plate 44 is a scraper edge 92. The scraper edge 92 is intended for use in cleaning applications, such as dishware cleaning, requiring an edge for use as a tool in the dislodgement of material. Referring to FIG. 9, the base plate 44 has a dispensing aperture 94. When assembled, dispensing aperture 94 of the base plate 44 aligns with the dispensing aperture 31 of the intermediate member 30 and with the outlet 27 of the handle 20 so that liquid can be dispensed from the reservoir in the handle 20 and out of the working head 40.

Figure 5B:
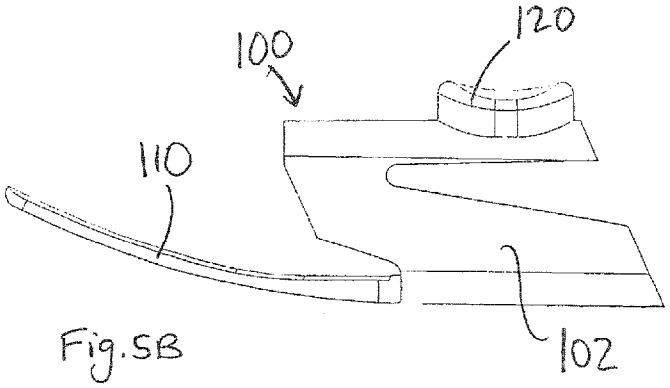
FIG. 5B is a side view the flow control member.
Figure 5C:
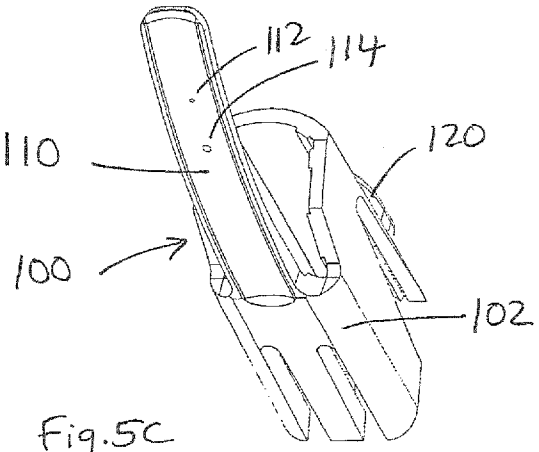
FIG. 5C is a perspective view from below of the flow control member.
Figure 5A:
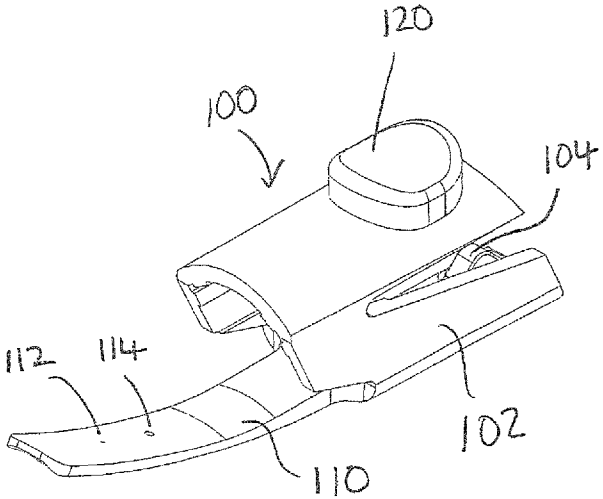
FIG. 5A is a perspective view from above of the flow control member of the apparatus of FIG. 1.
Figure 6:
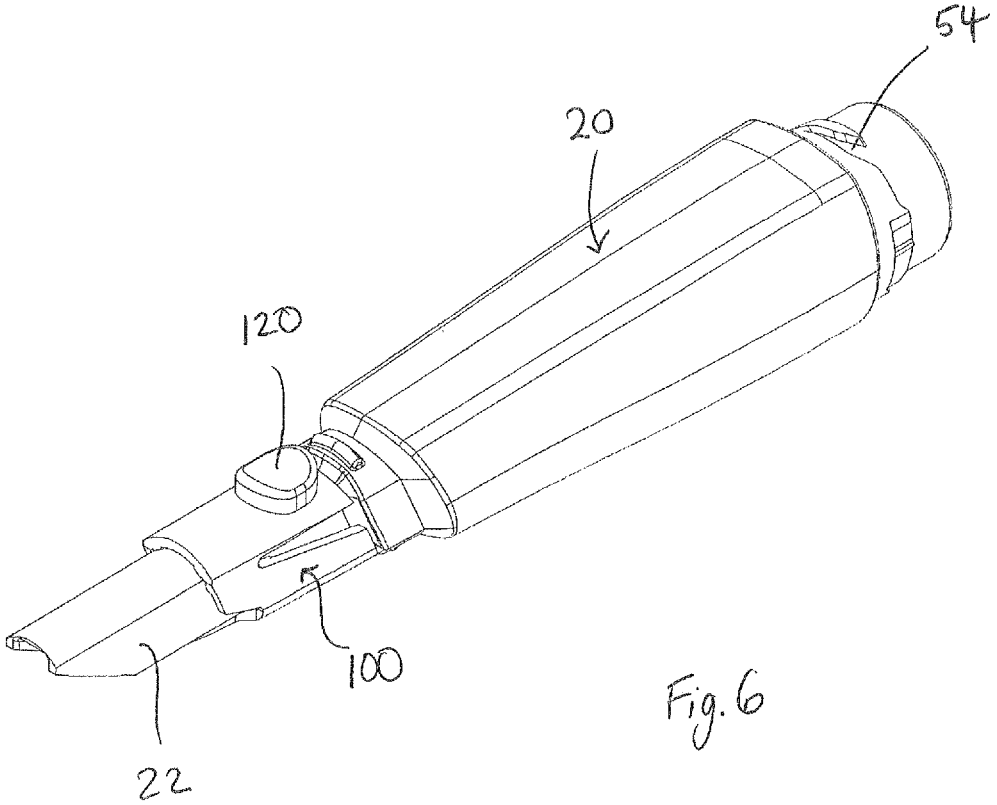
FIG. 6 is a perspective view from above of the handle and flow control member of the apparatus of FIG. 1 assembled together, the other components not shown in the figure.
Figure 7:
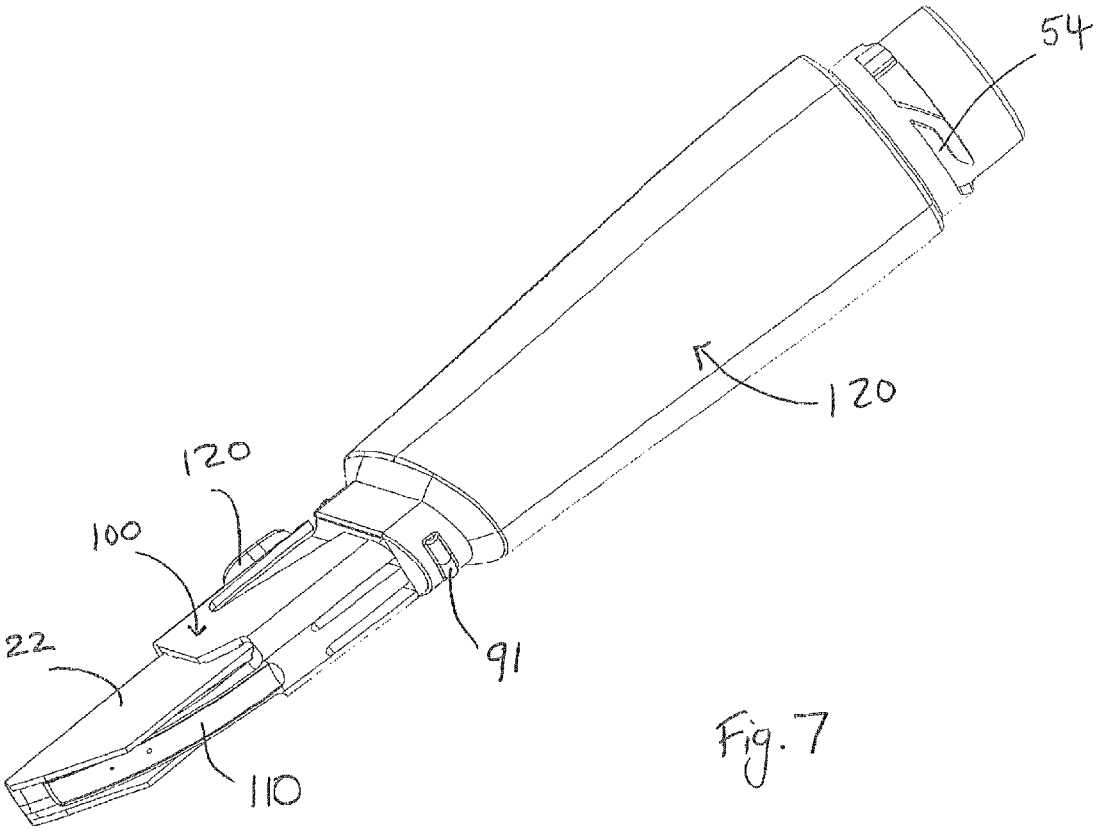
FIG. 7 is a perspective view from below of the handle and flow control member of the apparatus of FIG. 1 assembled together, the other components not shown in the figure.

The apparatus 10 further comprises a flow control member 100 for controlling the flow of fluid from the handle. The flow control member 100 is mounted within the intermediate member 30 and is movable between a closed position in which fluid is blocked from dispensing from the handle 20 and at least a first open position in which fluid is not blocked from dispensing from the handle 20. Referring to FIG. 5*a*, the flow control member 100 is provided as a one-piece plastic moulding having a body portion 102, a valve portion 110 and an actuator portion 120. Referring to FIG. 6, the body portion 102 forms a sleeve having a throughbore with proximal and distal open ends, the body portion 102 being shaped to receive the distal end portion 22 of the handle 20 so that the flow control member 100 can be received around the distal end portion 22 when assembled.

The actuator portion 120 comprises a protrusion that protrudes from the upper side of the body portion 102 so as to be accessible to the user when assembled. The intermediate member 30 has an oval shaped slot 95, configured such that the actuator portion 120 protrudes therethrough to allow the user to move the actuator portion to actuate the flow control member 100.

The valve portion 110 comprises a tongue extending from the lower side of the body portion 102. The valve portion 110 has first and second apertures 112, 114 of different sizes. The second aperture 114 in the flow control member 100 is no larger than the apertures 27, 31 and 94. When assembled the flow control member 100 is seated within the tubular inner sleeve 37 of the intermediate member 30, with the body portion 102 of the flow control member 100 received around the distal end portion 22 of the handle, and with the actuator portion 120 protruding through the slot 95. The lower side of the distal end portion 22 of the handle has a sloped recessed area 28 for receiving the valve portion 110 of the flow control member when assembled.

Figure 1:
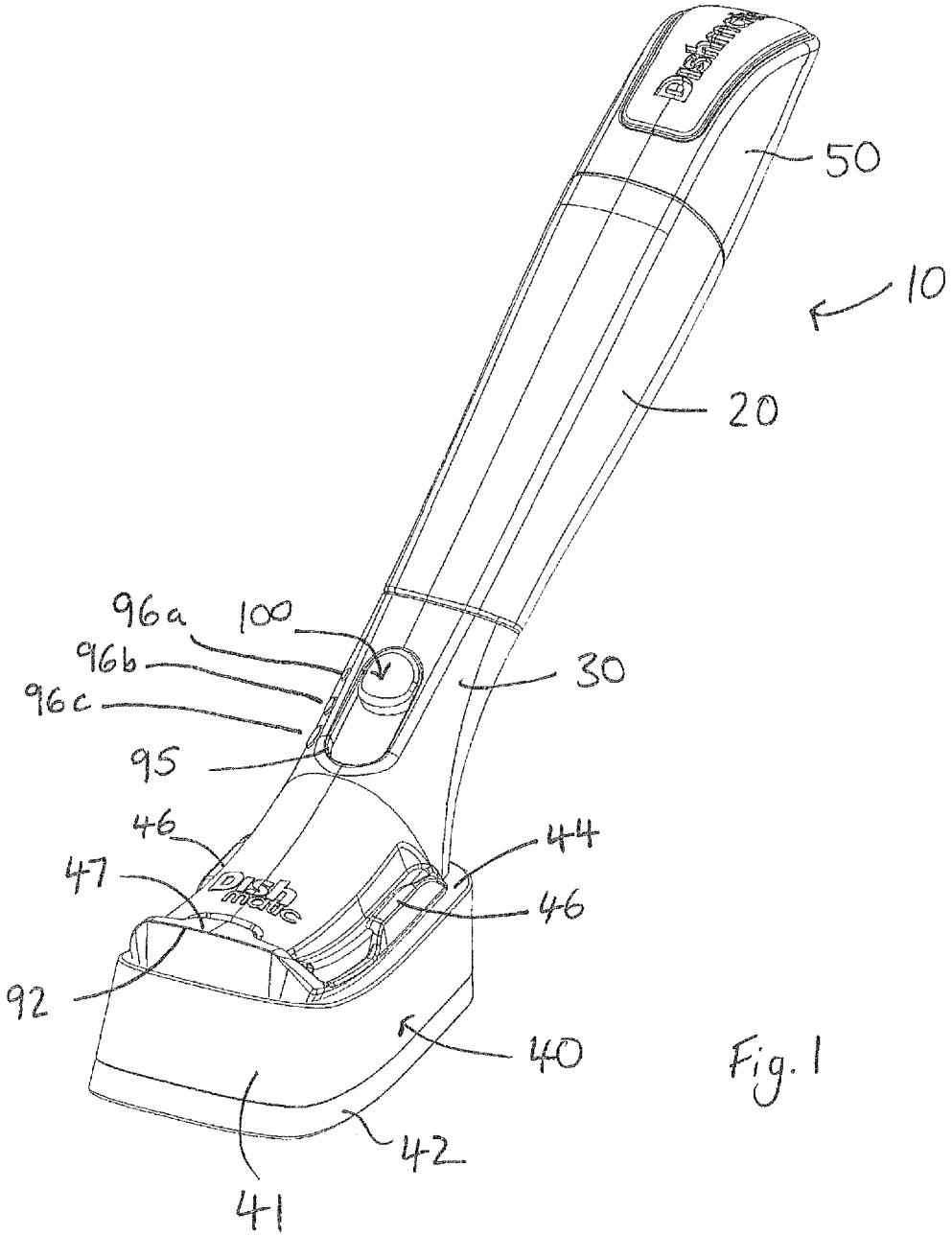
FIG. 1 is a perspective view of a fluid dispensing apparatus according to a first embodiment of the invention.
Figure 2A:
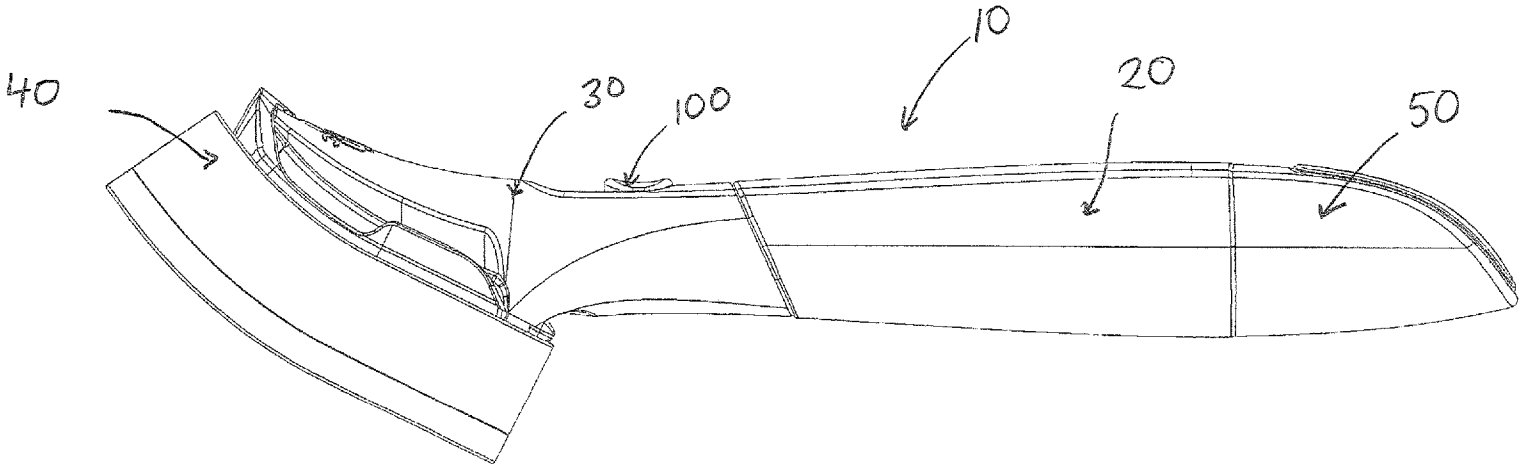
FIG. 2A is a side view of the apparatus of FIG. 1.
Figure 2B:
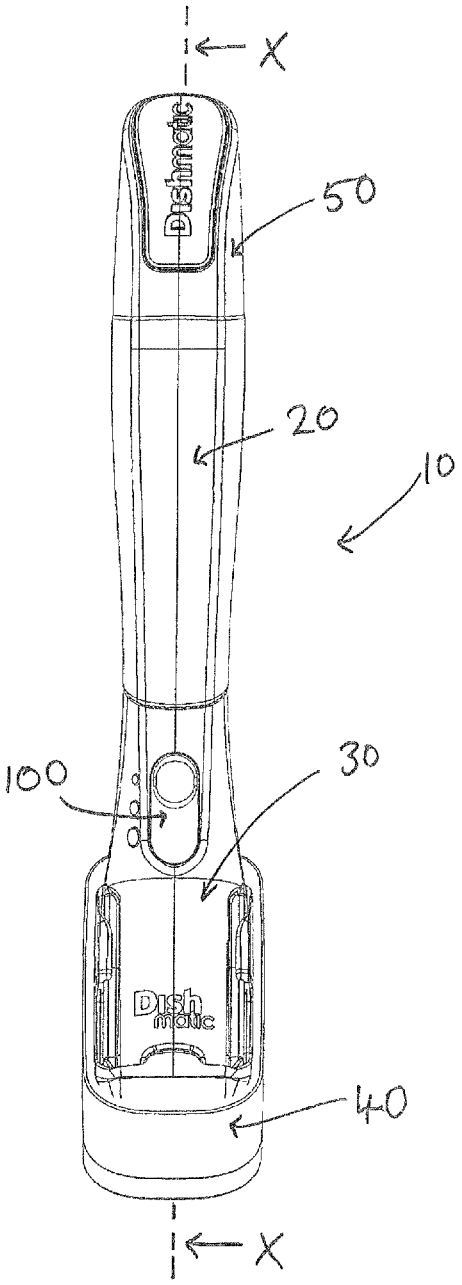
FIG. 2B is a top view of the apparatus of FIG. 1.
Figure 8:
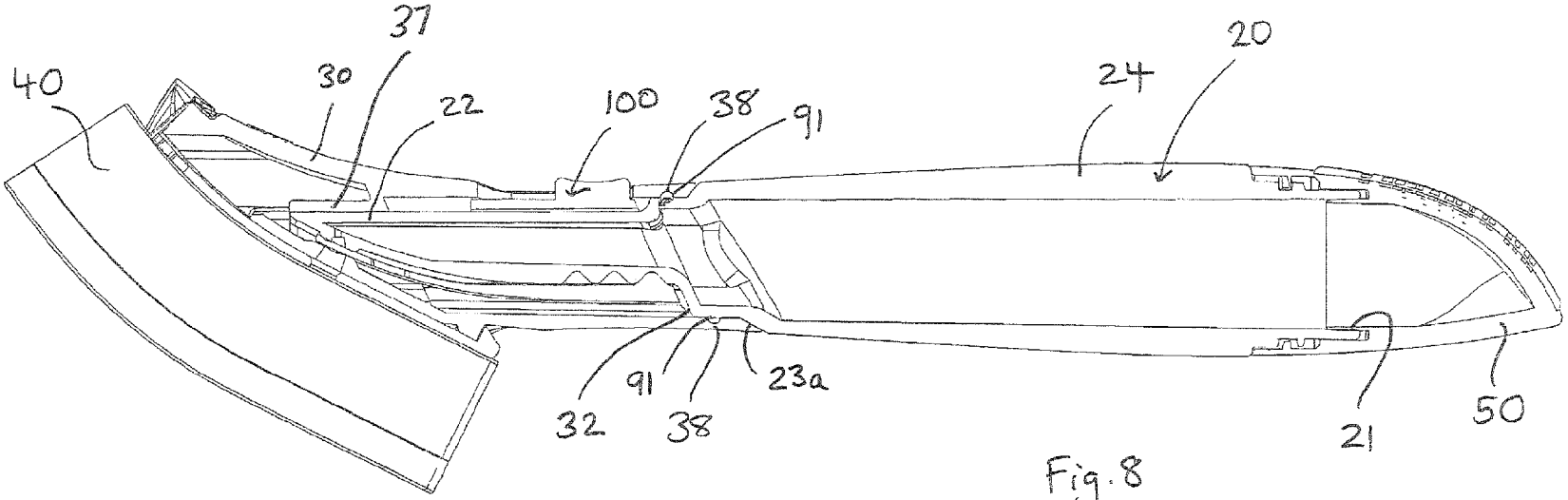
FIG. 8 is a cross-sectional view through the plane X-X, as shown in FIG. 2B.

The flow control member 100 is movable linearly, via a sliding action, distally and proximally relative to the handle 20 and intermediate member 30, between a closed position and first and second open positions. In the closed position, as shown in FIGS. 1 and 8, the solid distal end of the valve portion 110 aligns with the outlet 27 in the handle 20, such that fluid is blocked from dispensing from the handle 20. The actuator portion 120 can be advanced distally by the user to move the flow control member 100 to the first open position, wherein the first aperture 112 aligns with the outlet 27 in the handle 20, such that fluid can flow out of the handle, through aperture 112, through dispensing aperture 31 in the intermediate member and out of dispensing aperture 94 of the working head 40. The actuator portion 120 can be advanced distally from the first open position to the second open position, wherein the second aperture 114 aligns with the outlet 27 in the handle 20, such that fluid can flow out of the handle, through aperture 114, through dispensing aperture 31 and out of dispensing aperture 94 of the working head 40. As the second aperture 114 is larger than the first aperture 112, the second open position corresponds to a high flow rate configuration, whereas the first open position corresponds to a low flow rate configuration. This allows the user to select between first and second discrete flow control configurations. Further apertures of differing sizes could of course be provided in the valve portion to provide further discrete flow control configurations.

Referring to FIG. 5A, the flow control member 100 has a detent 104 protruding upwardly from the inner surface of the lower side of the body portion 102. Referring to FIG. 4, the lower surface of the distal end portion 22 of the handle has first, second and third detent recesses 97*a*, 97*b*, 97*c* for receiving the detent 104 to maintain the flow control member 100 in the closed, first open or second position, as selected by the operator. The detent recesses 97*a*, 97*b*, 97*c* are arranged in a line parallel with the longitudinal axis of the handle. When the detent 104 is seated in the first detent recess 97*a*, the flow control member is in the closed position. When the detent 104 is seated in the second detent recess 97*b*, the flow control member is in the first open position. When the detent 104 is seated in the third detent recess 97*c*, the flow control member is in the second open position. A small force is required to be applied by the operator to the actuator portion 120 to move detent 104 from one recess to an adjacent recess and therefore to move the flow control member between the discrete positions.

Referring to FIG. 1, the intermediate member 30 has three indication markers 96*a*, 96*b*, 96*c* on its outer surface that are visible to the user to indicate the three discrete flow control configurations that the flow control member 100 can be moved between. In this embodiment the indication markers 96*a*, 96*b*, 96*c* are raised from the outer surface of the intermediate member 30 so that the operator can feel the indication markers, however it will be understood that the indication markers need not be raised, but may be flush with the outer surface or indented in the outer surface of the intermediate member 30. The indication markers 96*a*, 96*b*, 96*c* are circular marks, arranged in a line in the proximal to distal direction, each indication marker being larger than the marker proximal to it. When the actuator portion 120 is aligned with the first indication marker 96*a*, this indicates to the operator that the flow control member is in the closed position. When the actuator portion 120 is aligned with the second indication marker 96*b*, this indicates to the operator that the flow control member is in the first open position (i.e. the low flow configuration). When the actuator portion 120 is aligned with the third indication marker 96*c*, this indicates to the operator that the flow control member is in the second open position (i.e. the high flow configuration).

The cap 50 attaches to the handle 20 via a bayonet fitting. This ensures that the cap 50, whose upper and lower sides are not symmetrical with one another, attaches to the handle 20 in the desired orientation relative to the handle 20. Referring to FIG. 3, the cap 50 has two male bayonet protrusions 52 protruding inwardly from the opposite sides of the inner rim of the cap. The proximal end of the handle 20 has two corresponding female bayonet receivers 54 that engage with the bayonet protrusions 52 on the cap to secure the cap to the handle. The cap 50 may of course attach to the handle 20 using any other suitable attachment means whereby the cap 50 is releasably and sealably attachable to the handle 20, for example by means of threaded engagement.

The apparatus can be stored between uses with the flow control member 100 in the closed position, so as to prevent leakage of the fluid from the reservoir. When a user wishes to use the apparatus, for example for cleaning dishes, the user can move the actuator portion 120 of the flow control member 100 to the first or second open positions, depending on the level of flow of detergent fluid desired. Once the flow control member 100 is in the first or second open position, fluid can flow out of the outlet 27 in the handle, through the selected aperture 112, 114 in the flow control member 100, through the dispensing apertures 31, 94, to dispense fluid from the working head.

In the embodiment described above, the flow control member 100 is movable linearly between the closed and open positions. However, the flow control member 100 need not move linearly, but could be configured to move rotatably between the positions.

The handle 20 and intermediate member 30 are preferably injection moulded. During manufacture of the apparatus, after the units of the assembly have been made, they are assembled together as described above. Since the intermediate member 30 is a separate piece from the handle 20, the intermediate member 30 can be selected from a range of different shapes and/or sizes to suit different uses. For example, the intermediate member illustrated in FIGS. 1 to 9 is suitable for general washing of dishes however a narrower intermediate member 30 for receipt within bottle necks could be used in the assembly so that the apparatus could be used as a bottle cleaning device.

Figure 10:
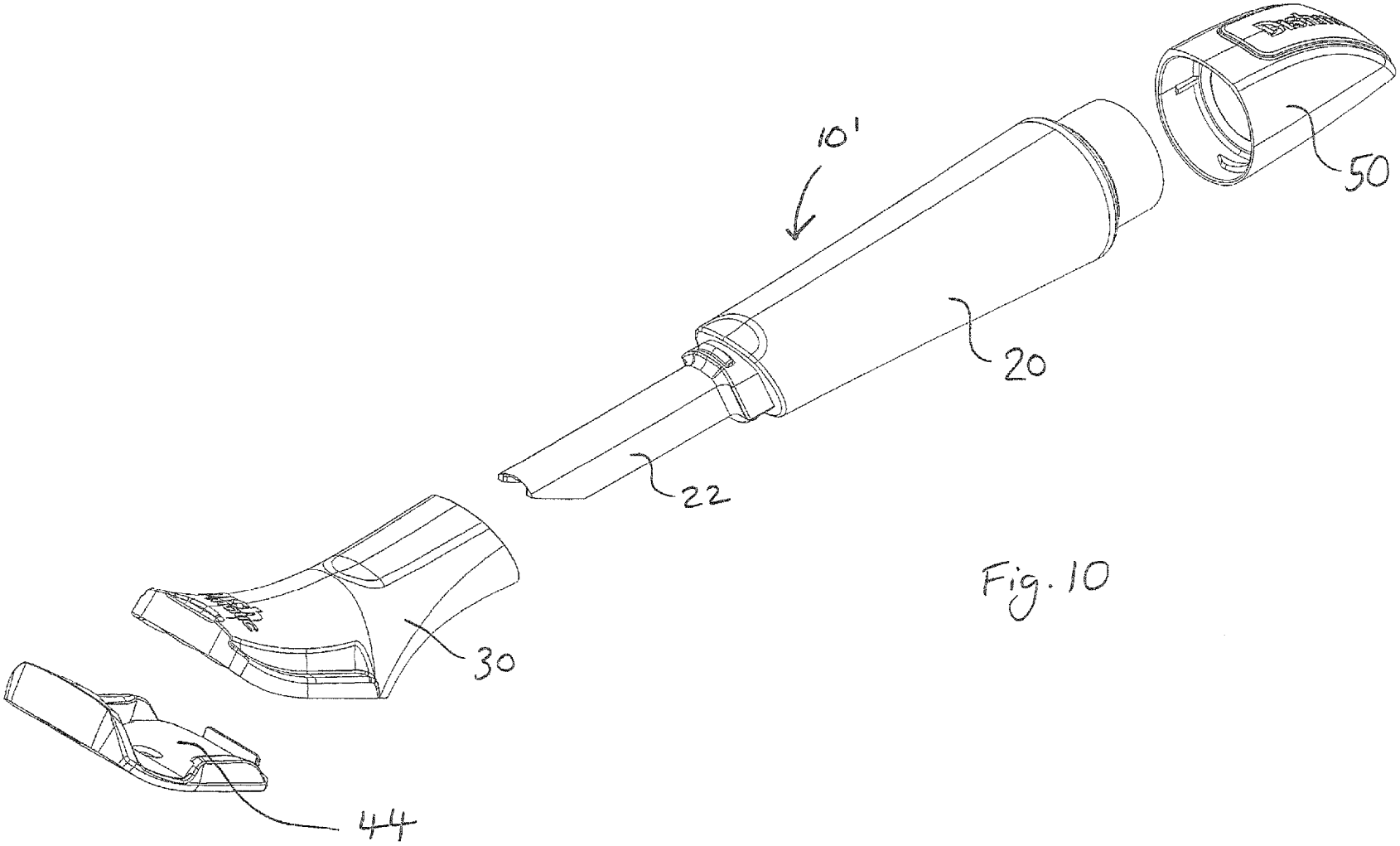
FIG. 10 is an exploded perspective view of a fluid dispensing apparatus according to a second embodiment, the apparatus not including any flow control member.

The apparatus need not include a flow control member 100. Referring to FIG. 10, a fluid dispensing apparatus 10' is shown which is similar to that of FIGS. 1 to 9, but which does not include a flow control member 100. Like reference numerals are used to show features which correspond to those in the previous embodiment. The assembly of FIG. 10 has a handle 20 with distal end portion 22 which is received within an intermediate member 30, the assembly further comprising a working head 40 which attaches to the intermediate member 30. The device therefore has the advantage of being made from a modular assembly of a hollow handle 20 for storage of the fluid and an initially separate intermediate member 30 which assembles thereto and which can be selected during manufacture from two or more intermediate members of different shapes and/or sizes to suit different uses.

Suitable means other than as shown in FIGS. 1 to 9 may be used for releasably latching the working head 40 to the intermediate member 30.

The invention claimed is:

1. A fluid-dispensing apparatus comprising a hollow handle, a working head from which fluid may be dispensed and an intermediate member, the hollow handle providing an enclosure defining a fluid reservoir therein, the handle having a distal end portion and having an outlet located in the distal end portion, the working head having a dispensing aperture for dispensing of fluid, the intermediate member being configured to receive the distal end portion of the handle therein, the working head being attachable to the intermediate member, the intermediate member having a dispensing aperture, the dispensing aperture of the intermediate member being in alignment with the outlet of the handle and with the dispensing aperture of the working head when assembled wherein the apparatus further comprises a flow control member for controlling the flow of from the handle, the flow control member being movable with respect to the handle outlet for selectively controlling the flow, the flow control member being received substantially within the intermediate member and the flow control member being movable linearly, via a sliding action, distally and proximally relative to the handle in order to control the flow of fluid from the handle, the flow control member having a throughbore for receiving at least part of the distal end portion of the handle therethrough.

2. A fluid-dispensing apparatus according to claim 1, wherein the flow control member has a valve portion, the valve portion being received in a space between a surface of the handle and a surface of the intermediate member.

3. A fluid-dispensing apparatus according to claim 2, wherein the valve portion of the flow control member has at least a first aperture, the valve portion being movable with respect to the handle outlet for selectively aligning the first aperture with the handle outlet.

4. A fluid-dispensing apparatus according to claim 3, wherein the flow control member is movable between at least a first open position in which the first aperture is aligned with the handle outlet and a closed position in which part of the valve portion blocks the handle outlet.

5. A fluid-dispensing apparatus according to claim 4, wherein the flow control member can be maintained in an open position or closed position via detent action.

6. A fluid-dispensing apparatus according to claim 5, wherein one of the flow control member and an adjacent surface has a detent and the other has at least one detent recess for receiving the detent for maintaining the flow control member in a selected position. via detent action.

7. A fluid-dispensing apparatus according to claim 6, wherein the flow control member has a detent and an adjacent surface of the handle has at least one detent recess for receiving the detent for maintaining the flow control member in a selected position via detent action.

8. A fluid-dispensing apparatus according to claim 2, wherein the valve portion of the flow control member has at least first and second apertures of different sizes, the valve member being movable with respect to the handle outlet for selectively aligning the first or second aperture with the handle outlet.

9. A fluid-dispensing apparatus according to claim 8, wherein the flow control member is movable between first and second open positions corresponding to first and second discrete flow control positions, wherein when the flow control member is in the first open position the first aperture aligns with the handle outlet and when in the second open position the second aperture aligns with the handle outlet.

10. A fluid-dispensing apparatus according to claim 2, wherein the flow control member has an actuator portion, the actuator portion being accessible by a user, wherein movement of the actuator portion by the user causes the valve portion of the flow control member to move with respect to the handle outlet.

11. A fluid-dispensing apparatus according to claim 10, wherein the actuator portion of the flow control member is located on one side of the handle and the valve portion is located on the opposite side of the handle.

12. A fluid-dispensing apparatus according to claim 10, wherein the intermediate member has an opening, the opening being configured such that the actuator portion protrudes through said opening.

13. A fluid-dispensing apparatus according to any of claims 10, wherein the actuator portion is movable distally relative to the handle to move the flow control member from a closed position to an open position.

14. A fluid-dispensing apparatus according to claim 2, wherein the distal end portion of the handle has a recessed area for receiving the valve portion of the flow control member.

15. A fluid-dispensing apparatus according to claim 1, wherein the intermediate member has an opening for receiving the distal end portion of the handle therein.

16. A fluid-dispensing apparatus according to claim 1, wherein the working head is releasably attachable to the intermediate member.

17. A fluid-dispensing apparatus according to claim 1, wherein the working head is attachable to the intermediate member via a latching attachment.

18. A fluid-dispensing apparatus according to claim 1, wherein the working head comprises a base plate and a cleaning element.

19. A kit for assembly into a fluid-dispensing apparatus according to 1, wherein the kit comprises the parts of the assembly according to any preceding claim, the kit. comprising two or more said intermediate members of different sizes and/ or shapes.

* * * * *